United States Patent [19]

Martinmaas

[11] Patent Number: 4,809,629

[45] Date of Patent: Mar. 7, 1989

[54] SAIL RIG FOR A WIND PROPELLED VEHICLE

[76] Inventor: Werner W. Martinmaas, P.O. Box 6321, Reno, Nev. 89503

[21] Appl. No.: 132,411

[22] Filed: Dec. 14, 1987

Related U.S. Application Data

[63] Continuation-in-part of Ser. No. 19,303, Feb. 26, 1987, abandoned.

[51] Int. Cl.[4] ..... B63B 39/00

[52] U.S. Cl. ..... 114/39.1; 114/102; 114/61; 114/89

[58] Field of Search ..... 114/39.1, 39.2, 102, 114/103, 123, 43, 61, 89, 90, 91

[56] References Cited

U.S. PATENT DOCUMENTS

| | | | |
|---|---|---|---|
| 3,777,690 | 12/1973 | Garber | 114/123 |
| 3,870,004 | 3/1975 | Bailey | 114/39.1 |
| 3,981,258 | 9/1976 | Smith | 114/39.1 |
| 4,228,750 | 10/1980 | Smith et al. | 114/39.1 |
| 4,541,355 | 9/1985 | Denton | 114/39.1 |

FOREIGN PATENT DOCUMENTS

| | | | |
|---|---|---|---|
| 1156952 | 3/1958 | France | 114/102 |
| 86/02330 | 4/1986 | World Int. Prop. O. | 114/103 |

*Primary Examiner*—Joseph F. Peters, Jr.
*Assistant Examiner*—Edwin L. Swinehart
*Attorney, Agent, or Firm*—Wood, Dalton, Phillips, Mason & Rowe

[57] ABSTRACT

A sail rig for a wind propelled vehicle that has a deck surface includes a support on the vehicle providing a pivot axis generally normal to the deck surface, a boom that has a proximal end pivoted on the support for 360 degree rotation about the pivot axis and a distal end with an upwardly extending sail mounting arm. A lightweight sail frame is pivoted on an upper end of the mounting arm to turn about a rotational axis between a first nearly upright position and a neutral position substantially parallel to the deck surface, and a sail has its periphery fixedly secured to the sail frame so that it turns about said rotational axis between said first position and said neutral position. The location of the sail frame relative to said rotational axis, and the structure and shape of the sail frame and the sail S are so coordinated that the sail frame and sail are urged by gravity to said first position and tend to be moved toward said neutral position by wind pressure on the sail. In addition, a spring that acts between the mounting arm and the sail frame biases the sail to neutral position, a sail control line is secured to the sail frame and is operable by a person in the vehicle to set the sail at any desired angle between the neutral position and the first position, and boom control means is operable by a person in the vehicle to control the rotation position of the boom on the pivot axis. Preferably the boom is longitudinal extensible, and a pivoted member suspended from the outer end of the boom contacts a medium upon which the vehicle is supported to limit tilting of the vehicle toward the side over which the boom extends.

29 Claims, 3 Drawing Sheets

FIG. 1
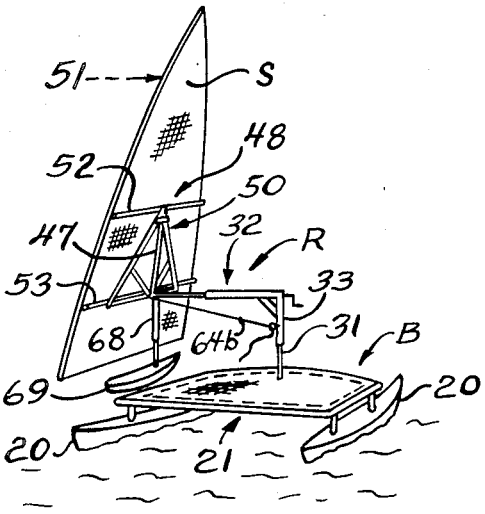
FIG. 3
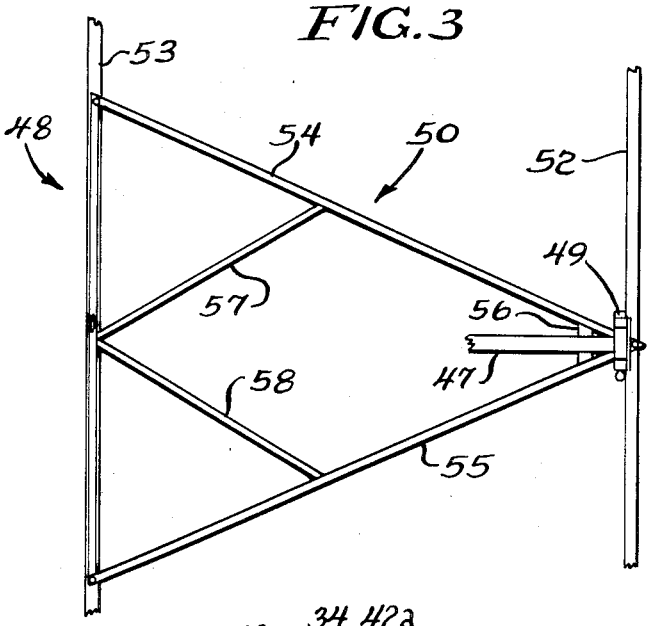
FIG. 2
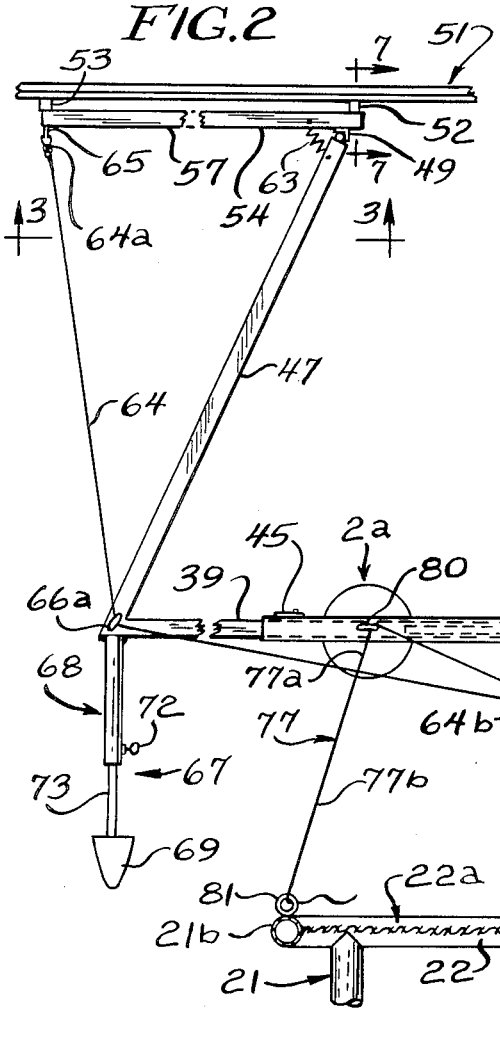
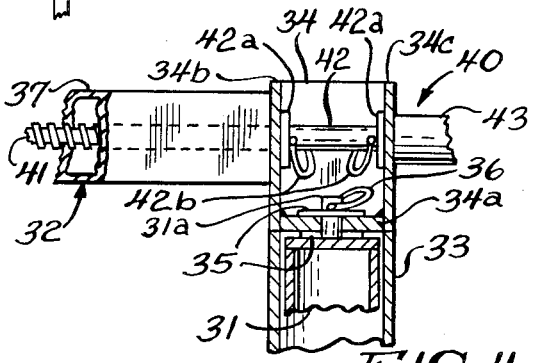
FIG. 4
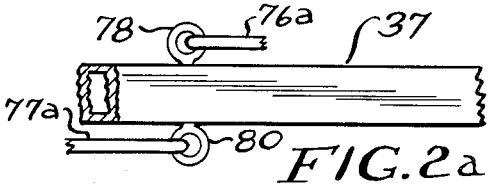
FIG. 2a

SAIL RIG FOR A WIND PROPELLED VEHICLE

CROSS REFERENCE

This application is a continuation-in-part of my copending application Ser. No. 019,303, filed Feb. 26, 1987, and entitled "Sail Rig for a Wind Propelled Vehicle".

FIELD OF THE INVENTION

The invention relates to a sail rig for a wind propelled vehicle that mounts the sail in such a way as to provide highly efficient use of available wind, substantially eliminate the risk of capsizing, and in the case of a boat promote planing of the boat floating in water.

BACKGROUND OF THE INVENTION

For many centuries sails for wind propelled vehicles such as boats have been mounted upon a mast, usually with one or more booms supported upon the mast to maintain the sail in an extended position with respect to the mast. There are several factors that cause the historic ways of rigging sails upon a boat to provide very inefficient use of the available wind, and to produce an inherent tendency to capsize the vessel unless the sails are reefed in higher winds.

In the first place, the force of the wind upon a conventionally rigged sail tends to cause a boat to heel over, so that to achieve maximum speed it is necessary to operate at what are sometime dangerously tilted angles which fail to take maximum advantage of hull shape for efficient travel through the water. The tendency of a conventionally rigged sailboat to heel over makes it necessary to use a very heavy keel that adds substantially to the weight of the boat and to the underwater surface area that reduces the efficiency of the boat's progress through the water. In addition, the pressure of the wind upon the sail or sails tends to drive the hull of a conventionally rigged boat into the waves instead of lifting it over them.

Prior art patents known to applicant that disclose unconventional sail rigs for sailing vessels include Bailey U.S. Pat. No. 3,870,004, Smith 3,981,258, Smith et al. 4,228,750, and Denton 4,541,355; a PCT international patent application of Crowell et al published Apr. 24, 1986, Publication No. WO 86/02330; French Patent No. 1,156,952 of Maillett; and Dowler's British Patent No. 5342 of 1897.

None of the above-identified prior art is capable of producing the results that are possible with applicant's sail rig.

None of the above-listed prior art sail rigs possesses the safety features of the present device—i.e., they have neither the mounting of the sail and frame so that they are moved by wind pressure to a neutral position, nor the spring to move the sail and sail frame to a neutral position in a light wind. The French Patent to Maillett shows the use of springs, but they are for a totally different purpose and in no way suggests the use of a spring in the way that applicant uses it.

No prior art patent discloses any sail rig that is a simple, inexpensive and easy to mount and use as is applicant's.

SUMMARY OF THE INVENTION

In accordance with the present invention, a sail rig for a wind propelled vehicle that has a deck surface includes a support on the vehicle providing a pivot axis generally normal to the deck surface, a boom that has a proximal end pivoted on the support for rotation about the pivot axis and a distal end, an upwardly extending sail mounting arm fixed to said distal end of the boom, said mounting arm having an upper end, a lightweight sail frame pivoted on a rotational axis on the upper end of the mounting arm for rotation between a first nearly upright position and a neutral position substantially parallel to the deck surface, and a sail fixedly secured to the sail frame. The location of the sail frame relative to said rotational axis, and the structure and shape of the sail frame and the sail are so coordinated that the sail frame and sail are urged by gravity to said first position and tend to be moved toward said neutral position by wind pressure on the sail. A manual sail control element is secured to the sail frame and is operable by a person on the vehicle to set the sail at any desired angle between the neutral position and the, first position and boom control means is operable by a person on the vehicle to control the rotational position of the boom on the pivot axis.

In a preferred embodiment of the invention a spring acts between the mounting arm and the sail frame to urge the sail toward the neutral position. In addition, in a preferred embodiment of the invention the boom has two telescoping boom members that permit adjustment of the boom length by means operable by a person in the vehicle.

The word "vehicle" is used herein in its broadest sense to include any kind of water craft, ice boats, and wheeled vehicles for movement over land.

The term "deck surface" is used only to provide a reference plane for describing the orientation of various parts of the sail rig and sail relative to the vehicle. Thus, a water craft such as a canoe may have only one or more transverse thwarts that extend across the hull of the canoe between the gunnels, and for purposes of the present specification and claims the upper surface of a thwart is a "deck surface". Many rowboats, dories and the like lack a conventional deck, but have a transverse member with an upper surface that provides the necessary reference plane to constitute a "deck surface".

The way in which the rig of the present invention supports a sail upon a wind propelled vehicle causes the force of the wind upon the sail to tend to lift the vehicle, rather than driving it downwardly; and this is particularly important in the case of a water craft because it tends to make the craft plane over the surface of the water instead of forcing it down into the water.

Another major advantage of the present sail rig is that it has little tendency to cause a vehicle to heel over, so that the vehicle maintains a very even keel and may be safely operated in wind velocities that would be disastrous for a vehicle provided with a conventionally rigged sail.

A major safety feature of the present sail rig is that it permits a fully rigged sail to occupy a "neutral" position that is generally parallel to the deck surface of the vehicle; and in that position the wind exerts no effective propulsive force upon the sail. By coordinating the location of the sail frame rotational axis with the structure and shape of the sail frame and sail so that the sail frame and sail are urged by gravity to said first position and tend to be moved toward said neutral position by wind pressure on the sail, in a moderate wind an operator need only release the manual sail control element to almost instantaneously eliminate any propulsive force tending to drive the vehicle.

Furthermore, by providing the sail rig with a spring that normally retains the sail in the neutral position, nearly instantaneous elimination of propulsive force occurs independent of wind velocity. This can be extremely important in the case of a sailboat if somebody goes overboard.

THE DRAWINGS

FIG. 1 is a generally diagrammatic perspective view of a Hobie Cat sailboat equipped with the sail rig of the invention;

FIG. 2 is a fragmentary elevational view of the sail rig of the invention with the boom pivoted to extend longitudinally of the boat, with the sail frame and sail in a neutral position generally parallel to the deck surface of the boat, and with parts of the sail frame broken away for . clarity of illustration;

Figure 5:
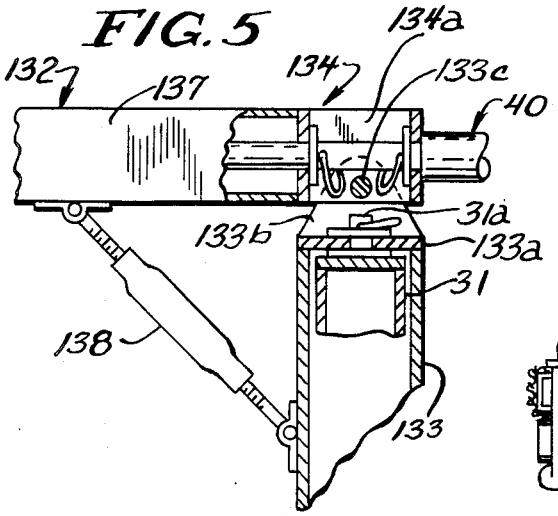
Figure 6:
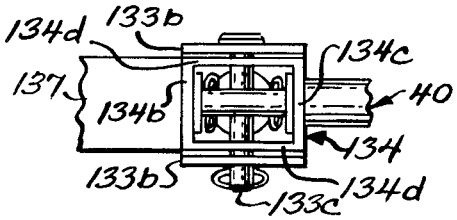
Figure 7:
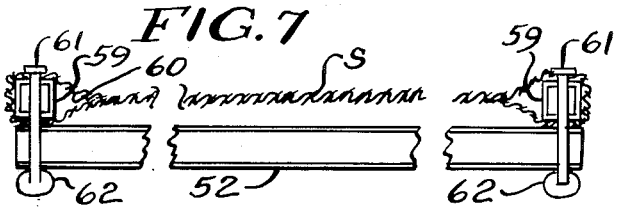
Figure 10:
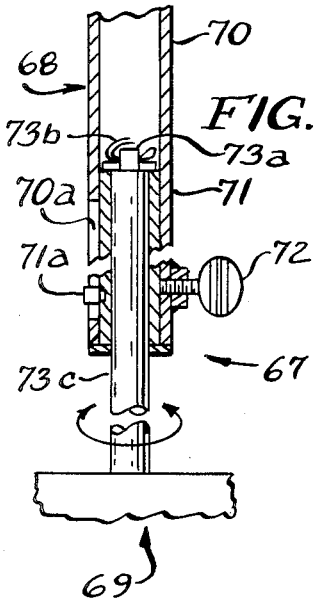
Figure 8:
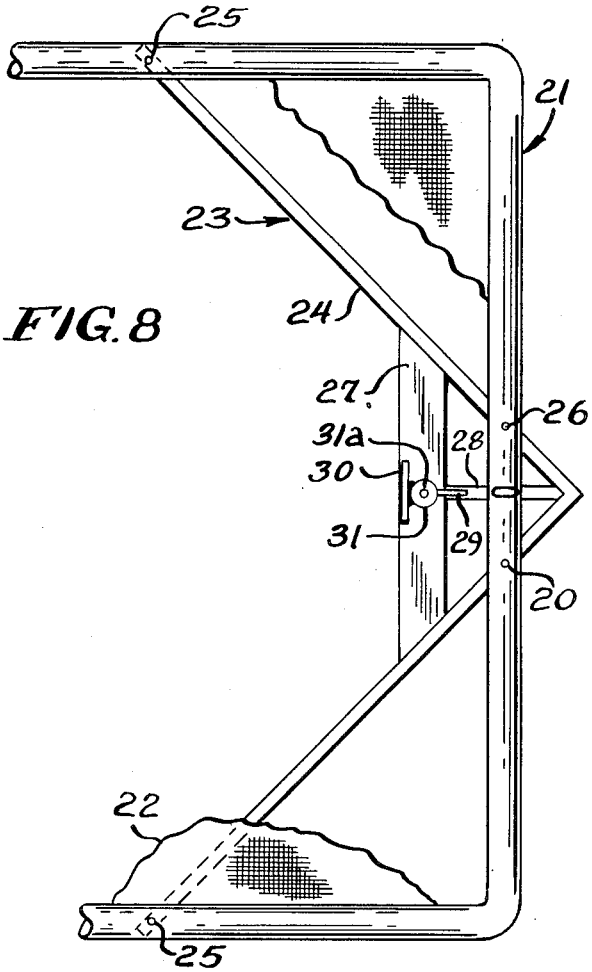
Figure 9:
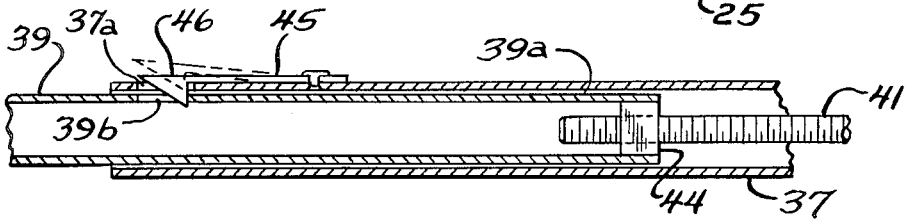
Figure 14:
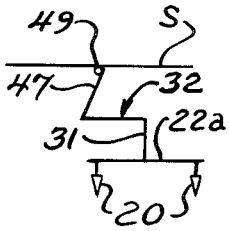
Figure 15:
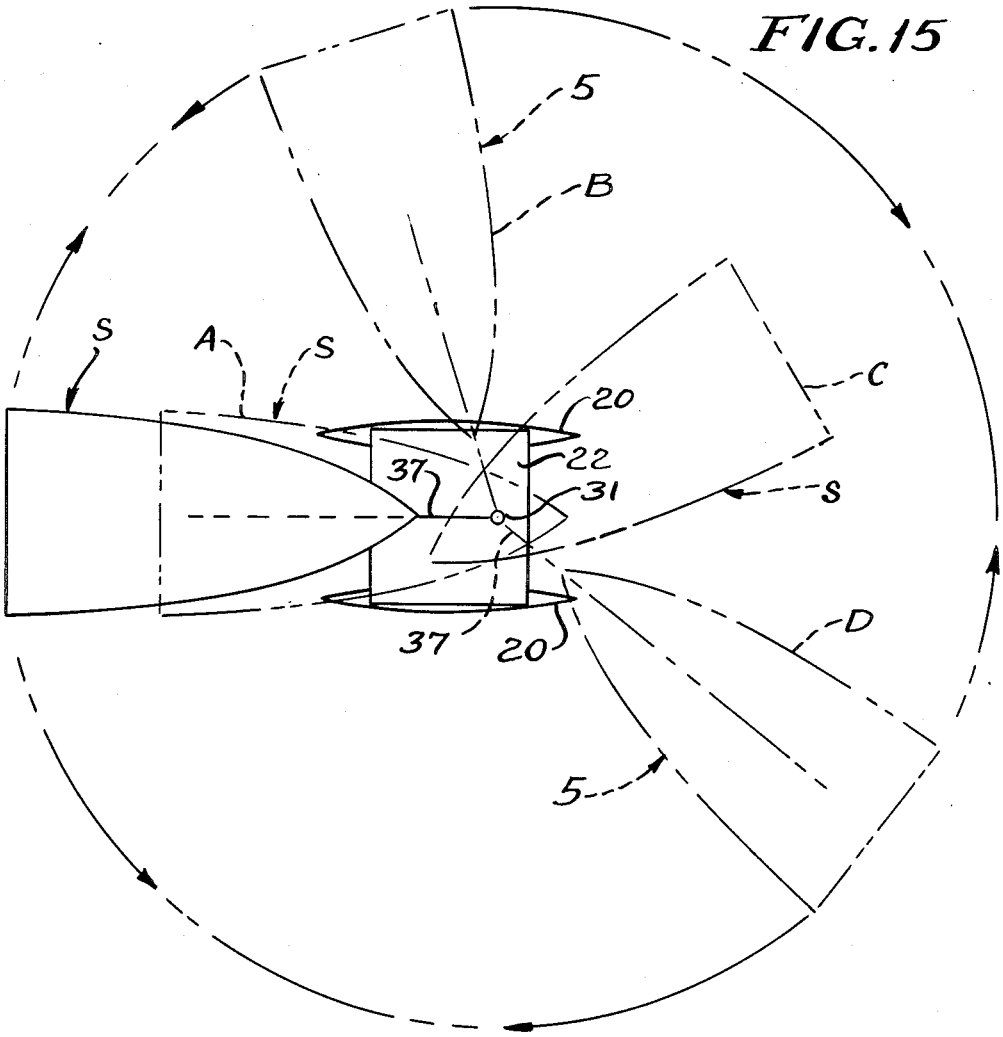

FIG. 2*a* is a fragmentary plan view on an enlarged scale of the part of the boom enclosed by the circle 2*a* in FIG. 2;

FIG. 3 is a fragmentary elevational view taken substantially as indicated along the line 3—3 of FIG. 2 with only an inner mounting portion of the sail frame illustrated and the sail removed;

FIG. 4 is a fragmentary sectional view on an enlarged scale illustrating the mounting of the boom upon the support in the embodiment of the invention illustrated in FIG. 2;

FIG. 5 is a fragmentary sectional view similar to FIG. 4 but illustrating an alternative mounting of the boom upon the support;

FIG. 6 is a fragmentary plan view of the alternative mounting of FIG. 5;

FIG. 7 is a fragmentary sectional view illustrating the mounting of the sail upon the sail frame;

FIG. 8 is a fragmentary plan view that illustrates an adapter for mounting the sail rig of the invention upon a Hobie Cat;

FIG. 9 is a longitudinal, fragmentary sectional view of the telescoping connection between proximal and distal portions of the extensible boom to illustrate the operation of a latch that limits the extension movement of the distal portion of the boom;

FIG. 10 is a fragmentary sectional view on an enlarged scale illustrating the swivel mounting of a sponson at the outer end of the boom;

FIGS. 11–14 are diagrammatic elevational views illustrating different angular dispositions of the sail frame and sail relative to the deck; and FIG. 15 is a diagrammatic plan view that illustrates the boom and the sail in full lines in an extreme outboard, neutral position extending from the stern of the boat, and that also illustrates the boom and the sail in four broken line positions A, B, C, and D extending at different angles from the boat, the sail being in its extreme inboard position at A and C and in its extreme outboard position at B and D.

DETAILED DESCRIPTION OF THE INVENTION

Referring to the drawings in detail, and referring first to FIGS. 1–3, a boat, indicated generally at B, is provided with the sail rig of the invention, indicated generally at R, that mounts a sail S. The boat B is illustrated schematically as a Hobie Cat that has twin hulls 20 supporting a framework, indicated generally at 21, fixed upon which is a tensioned canvas deck 22 that has a top surface 22*a* which is referred to in the specification and claims as a "deck surface" and which is used as a reference plane for the purpose of describing the relative positions of various parts of the sail rig R.

The sail rig R of the present invention is illustrated and described with reference to a Hobie Cat because that is the type of water craft upon which it was the easiest for applicant to mount and test the sail rig. However, it is apparent that the sail rig R could be used upon any water craft from a wind-surfer, a canoe, row boat or cat boat to a ship of substantial size that would conventionally carry a plurality of masts and many sails. The sail rig could also be used upon an ice boat or upon a wheeled land vehicle.

Referring to FIG. 8, because of the way in which a Hobie Cat frame 21 is constructed it is necessary to mount upon it an adapter, indicated generally at 23, that consists conveniently of a V-frame 24 bolted at 25 to the sides of the frame 21 and bolted at 26 to the bow end of the frame 21, a cross plate 27 welded to the two arms of the V-frame 24, and a longitudinal brace 28 between the apex of the V-frame 24 and the median line of the cross plate 27. A longitudinal web 29 and a transverse web 30 complete the adapter 23.

The sail rig R includes an upright support 31 the lower end portion of which is welded to the plates 29 and 30. The support is about 3 feet (0.91 m) tall and 3 inches (7.62 cm) in outside diameter. For a larger craft it is perfectly apparent that the support 31 might need to be substantially taller and of substantially larger diameter. The support 31 provides a pivot axis that is generally normal to the deck surface 22*a*. On the pivot axis is an upwardly projecting integral pin 31*a*.

In a monohull craft that has a well or socket in which a mast is stepped, the support 31 would be mounted in the well or socket.

As seen in FIGS. 2 and 4, a boom structure, indicated generally at 32, includes a sleeve 33 that surrounds the support 31 and is rotatable 360 degrees about the pivot axis afforded by the pin 31*a*. Welded to the top of the sleeve 33 is a square cup 34 that has a bottom plate 34*a* with a central bore that makes an easy rotating fit upon the pin 31*a*. Washers 35 surround the pin 31*a* below and above the cup bottom wall 34*a*, and a retainer clip 36 snaps into holes in the pin 31*a* to hold the sleeve 33 in place.

Welded to a wall 34*b* of the cup 34 is a first, proximal, boom member 37 consisting of a square tube that, in the illustrated embodiment, is 6 feet 6 inches (1.98 m) in length, and 2 inches (5.08cm) outside dimension across opposite walls of the square. A diagonal brace 38 is seen in FIG. 2 to be welded to the sleeve 33 and to the first boom member 37.

A second, distal boom member 39 is also 6 feet 6 inches (1.98 m) in length, and made of a square tube that is 1-¾ inch (4.445 cm) outside dimension across opposite walls of the square so as to make an easy telescoping fit within the first boom member 37. As best seen in FIGS. 2, 4 and 9, the second boom member 39 is longitudinally adjustable relative to the first boom member 37 by means of a screw and nut drive, indicated generally at 40. A long pitch screw 41 has an unthreaded shank 42 that is journalled in holes in the cup wall 34*b* and in an opposite cup wall 34*c*, and a hand crank 43 is fixed to the shank 42 as seen in FIG. 2. Welded into a proximal end 39*a* of the second boom member 39 is a threaded nut 44 that receives the screw 41, so that rotation of the hand crank 43 in one direction or the other may either extend of retract the second boom member 39. As seen in FIG. 9, a spring latch 45 on the distal end of the first boom member 37 has a wedge shaped tooth 46 that extends through a hole 37*a* in the first boom member and engages in a hole 39*b* close to the proximal end 39*a* of the second boom member 39 so as to limit the maximum length to which the boom may be adjusted. Washers 42*a* and attaching clips 42*b* within the cup 34 complete the structure and mounting of the drive screw 41.

Referring now to FIGS. 5 and 6, there is illustrated a boom 132 which differs from the boom 32 in being pivotally mounted relative to the upper end portion of a sleeve 133 which is rotatably mounted upon the support 31 as is the sleeve 33 in the embodiment of FIG. 4.

Pivotal mounting of the boom 132 is accomplished by providing the sleeve 133 with a top plate 133*a* that carries a pair of parallel flanges 133*b* that support a pivot pin 133*c*.

At the inner end of a first boom member 137 is welded a hollow square member 134 having walls 134*b* and 134*c* that support a screw of a screw and nut drive 40 which is identical with that in the embodiment of FIG. 4 and thus is not described further.

The hollow square structure 134 has opposite walls 134*d* that are bored to receive the pivot pin 133*c* in order that the boom 132 may swing in a plane that includes the pivot axis indicated by the pin 31*a* surmounting the support 31.

Pivotal movement of the boom 132 is provided for by a turnbuckle 138 that replaces the fixed brace 38, and of course the turnbuckle structure not only permits the boom 132 to swing about the pivot pin 133*c*, but also fixes it in any desired position of angular adjustment relative to the support 31.

Referring now particularly to FIG. 2, integral with a distal end of the second boom member 39 is an upwardly extending sail mounting arm 47 that occupies an angle of approximately 65 degrees relative to the outer boom member 39. The angle is not critical, but does need to be less than a right angle because the line of the sail mounting arm 47 determines the maximum upright position of the sail.

Figure 11:
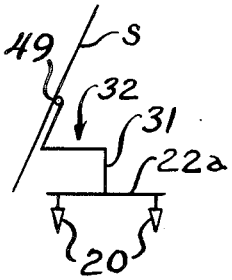
Figure 12:
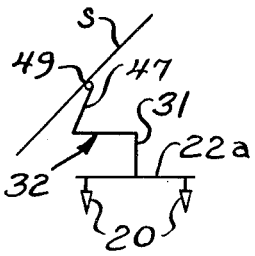
Figure 13:
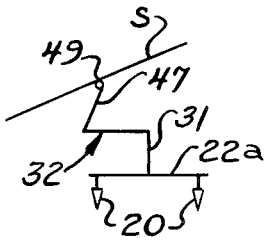

A sail frame, indicated generally at 48, is mounted upon the upper extremity of the sail mounting arm 47 on a removable pivot pin 49 that permits the sail frame and a sail S mounted thereon to be firmly secured to the mounting arm while being readily removable for storage. The pivot pin 49 provides a rotational axis about which the sail frame turns between the first nearly upright position that is seen in FIG. 11 and a neutral position that is seen in FIG. 14 in which the sail frame is substantially parallel to the deck surface 22*a*.

As best seen in FIGS. 1, 3 and 7, a sail frame 48 consists generally of an inner mounting portion, indicated generally at 50, an outer sail stretching portion, indicated generally at 51, a frame pivot end connecting member 52 and a frame control end connecting member 53. The inner mounting portion 50 of the sail frame consists of side frame members 54 and 55 defining a V that has its apex at the pivot 49 and its open end at the control end connecting member 53. A short cross member 56 extends across the narrow end of the V between the members 54 and 55, and from points intermediate the ends of the members 54 and 55 are bracing rods 57 and 58 that form a second, smaller V with its apex at the control end connecting member 53 and the opposite ends of the rods fixed to the inner mounting portion side frame members 54 and 55 intermediate the ends of said last named members.

The outer sail stretching portion 51 of the frame consists of a pair of arcuate rods 59 that are seen in FIG. 1 to be joined intermediate their ends to the pivot end connecting member 52 and to the control end connecting member 53, and that are joined at the apex of the sail S. As best seen in FIG. 7, the rods 59 are carried in tubular pockets 60 that are formed along the periphery of the sail S, and serve to maintain the sail S stretched to the shape illustrated in FIG. 1. The shape of the sail S is only exemplary of various different shapes that may be employed in the practice of the present invention, although it is apparent from the way in which the sail is mounted and utilized that a sail is particularly satisfactory if its long dimension is perpendicular to the rotational axis 49 about which the sail frame turns on the sail mounting arm 47. It is also desirable for the sail to taper toward the end that is uppermost when the sail is not in its neutral position.

As seen in FIG. 7, all the sail frame components are fabricated from relatively thin walled, hollow rectangular tube stock of an aluminum or magnesium alloy that is extremely light and strong for its weight; or plastic rod of suitable weight, strength and toughness may also be used for the sail frame.

The various sail frame members are seen in FIG. 7 to be secured to one another by pins 61 that extend through the frame members and are held by clips 62 that are like the clips 42*b* illustrated in FIG. 4.

The location of the sail frame 48 relative to said rotational axis 49, and the structure and shape of the sail frame 48 and the sail S are so coordinated that the sail frame and sail are urged by gravity to said first position and tend to be moved toward said neutral position by wind pressure on the sail. It is quite apparent that with sail frames and sails of different shapes, sizes and weights the location of the rotational axis on the frame must be varied to achieve the necessary coordination for proper sail action in a wind.

Means 63 are provided for moving the sail frame 50 to the neutral position illustrated in FIG. 14 independent of wind force, and such means 63 preferably takes the form of a spring that acts between the sail mounting arm 47 and the sail frame 50 in the vicinity of the rotational axis afforded by the pivot pin 49. For ease of illustration, a compression spring 53 is illustrated in FIG. 2; but it is quite apparent that in practice a coil spring wrapped around the pivot pin 49 would be more desirable.

A sail control line 64 has a standing part 64*a* secured to an eye 65 at the junction of the mounting portion bracing rods 57 and 58 with one another and with the control end connecting member 53. A running part 64*b* of the control line passes through a boom eye 66*a* at the distal end of the second boom member 39, a control eye 66*b* on the sleeve 33, and lies on the deck 22 where it may be used by a person sailing the boat to control the position of the sail S between the position of FIG. 11 and the neutral position of FIG. 14.

The alternative boom structure of FIGS. 5 and 6 has a sail control line that is mounted and guided exactly as is the line 64, just described.

The angular disposition of a boom member 37 or 137 relative to the pivot axis 31*a*, as seen in FIG. 15, is controlled by a boom control means, indicated generally at 75. The boom control means 75 includes a forward boom control line 76 and an aft boom control line 77.

The forward boom control line 76 has a standing part 76a anchored to an eye 78 that is on one side of the proximal boom member 37 close to the spring latch 45. A running part 76b of the forward boom control line passes through a forward control eye 79 that is seen in FIG. 2 to be mounted upon an extreme forward portion 21a of the deck frame 21.

The aft boom control line 77 has a standing part 77a secured to an eye 80 on the first boom member directly opposite the eye 78, and a running part 77b of the aft boom control line 77 passes through an eye 81 that is on the extreme aft end of the deck frame 21.

The present sail rig provides great flexibility of operation. For example, with the boom 37 and the sail S occupying the position C or D illustrated in FIG. 15, the forward boom control line 76 and aft boom control line 77 are used to control the boom angle for running before the wind; and this permits enormously efficient use of the available wind. With the boom appropriately set the boat can readily be sailed backward, which is impossible with a conventionally rigged sail.

When the boom member 37 and the sail S are occupying an aft position relative to the pivot axis 31a, the aft boom control line 77 is used to control boom angle, and the forward boom control line 76 may be loose.

With the sail S in the position A of FIG. 15, and with the sail in the neutral position shown in FIG. 2, a boat equipped with the present sail rig can be very easily propelled by paddles if it is necessary to proceed directly into the wind to enter a narrow inlet.

At the distal end of the second boom member 39 is a stabilizing assembly, indicated generally at 67, that consists of depending arm means, indicated generally at 68, and a stabilizing member consisting of a sponson 69 which may impinge upon the water to limit tilting of the boat in the direction of the distal end of the boom 32.

As seen in FIG. 10, the depending arm consists of an outer sleeve 70 the upper end of which is welded to the second boom member 39, an inner sleeve 71 which telescopes within the outer sleeve 70 to adjust the length of the depending arm, a set screw 72 which screws through a threaded boss in the outer sleeve 70 and has an inner end bearing upon the inner sleeve 71 to fix said inner sleeve in any desired adjusted position relative to the outer sleeve 70, and a sponson supporting rod 73 that pivots freely within the inner sleeve 71 so that the sponson 69 always maintains a long dimension parallel to the line of travel of the boat. A radially projecting stud 71a on the inner sleeve 71 slides in a slot 70a in the outer sleeve 70 to limit the amount of extension of the inner sleeve relative to the outer sleeve; and the upper end of the sponson support rod 73 has an extremity 73a of reduced diameter that extends through a transverse wall 71b of the inner sleeve 71 and receives a clip 73b to hold the sponson support rod 73 in the inner sleeve 71 while permitting it to rotate freely. As best seen in FIG. 1, the sponson mounting rod 73 is connected toward the front of the sponson 69 so that the latter hangs low at the rear. Typically on a boat such as a 14 foot (4.26 m) Hobie Cat, the length of the sponson will be about 4 feet (1.22 m), with the rod 73 connected about one foot (0.30 m) from the front of the sponson.

The position of the sail S illustrated in FIG. 14 is referred to as a neutral position herein because when the sail is in that position it can catch no wind and therefore cannot keep the boat under way. That, combined with the previously described tendency of wind to move the sail to neutral position and the spring means 63 biasing the sail S to its neutral position, provides a great safety feature if the sailor falls overboard and lets the sail control line run free, because there is only slight danger of the boat drifting away from the sailor.

Another major safety factor with the present sail rig is that, unlike a conventional sail that is rigged with a mast and boom, the force of the wind upon the sail S has very little tendency to cause the boat to heel over away from the wind, so the boat sails on a very even keel and can plane in a way that is impossible with a conventional sail rig. The force of the wind has a tendency to lift the boat off the water, instead of tending to force it into the water as is true with a masted boat, which is the reason that a boat having the sail rig of the present invention can actually plane and achieve extraordinary high speed relative to the velocity of the wind.

The fact that the boat sails upon a very even keel, coupled with the fact that the sailor controls the propelling force of the wind upon the sail by shifting the angle toward or from the neutral position of FIG. 14 as well as by shifting the disposition of the boom relative to the pivot axis, permits a boat with the present sail rig to be operated safely in winds the velocity of which would be completely disastrous for a conventionally rigged boat.

Extension and retraction of the boom also afford a control over the effect of wind upon the sail and the level of propulsive force exerted under various conditions.

The foregoing detailed description is given for clearness of understanding only and no unnecessary limitations should be understood therefrom, as modifications will be obvious to those skilled in the art.

I claim:

1. In a sail rig for a wind propelled vehicle that has a deck surface, the improvement comprising, in combination:

a support fixedly mounted on said vehicle that provides a pivot axis generally normal to the deck surface;

a boom that has a proximal end pivoted on said support for rotation about said pivot axis, and a distal end;

an upwardly extending sail mounting arm fixedly secured to said distal end of the boom, said mounting arm having an upper end;

a lightweight sail frame pivoted on a rotational axis on said upper end of the mounting arm for movement between a first nearly upright position and a neutral position substantially parallel to the deck surface;

a sail fixedly secured to the sail frame for movement therewith, the location of the sail frame relative to said rotational axis, and the structure and shape of the sail frame and the sail being so coordinated that the sail frame and sail are urged by gravity to said first position and tend to be moved toward said neutral position by wind pressure on the sail whereby said sail frame and sail must be restrained against moving to said neutral position when subjected to wind pressure;

a manual sail control element secured to said sail frame so a person on the vehicle may set the sail at any desired angle between said first position and said neutral position and said sail control element may be used to retain the sail frame and sail at said desired angle;

and boom control means operable by a person on the vehicle to control the rotational position of the boom on the pivot axis.

2. The combination of claim 1 which includes means biasing said sail frame to said neutral position.

3. The combination of claim 2 in which said means biasing the sail frame consists of a spring that acts between the mounting arm and the sail frame.

4. The combination of claim 2 which includes a pivot on the support that is generally parallel to the deck surface, the proximal end of the boom is mounted on said pivot, and means are provided for rotating the boom about said pivot to various angles relative to the pivot axis.

5. The combination of claim 2 in which the proximal end of the boom is fixed at a predetermined angle relative to the pivot axis.

6. The combination of claim 1 in which the boom has a first boom member that includes the proximal end and a second boom member that includes the distal end, and the second boom member telescopes relative to the first boom member to adjust the length of the boom between a minimum and a maximum length.

7. The combination of claim .4 which includes a pivot on the support that is generally parallel to the deck surface, the proximal end of the boom is mounted on said pivot, and means are provided for rotating the boom about said pivot to various angles relative to the pivot axis.

8. The combination of claim 6 that includes interengaging latch means on the first and second boom members to limit the maximum length to which the boom may be adjusted.

9. The combination of claim 6 in which the means for moving the sail frame to said neutral position comprises means biasing said sail frame to said neutral position.

10. The combination of claim .4 in which the proximal end of the boom is fixed at a predetermined angle relative to the pivot axis.

11. The combination of claim 6 in which the boom includes means operable by a person in the vehicle for telescoping the second boom member relative to the first boom member.

12. The combination of claim 11 in which the means operable by a person in the vehicle comprises a screw and nut drive and a hand crank for operating said drive.

13. The combination of claim 1 in which the proximal end of the boom is fixed at a predetermined angle relative to the pivot axis.

14. The combination of claim 1 which includes a pivot on the support that is generally parallel to the deck surface, the proximal end of the boom is mounted on said pivot, and means are provided for rotating the boom about said pivot to various angles relative to the pivot axis.

15. The combination of claim 1 which includes a depending arm at the distal end of the boom, and a stabilizing member pivotally suspended from the bottom of the arm to contact a medium upon which the vehicle is supported for the purpose of limiting tilting movement of the vehicle toward the side over which the boom extends.

16. The combination of claim 15 which includes means for adjusting the length of the depending arm.

17. The combination of claim 1 in which the vehicle is a boat having a hull that is adapted to float in water, and in which the rig includes a depending arm at the distal end of the boom, and a sponson that has a long dimension and a short dimension, said sponson being pivotally suspended from the bottom of the arm to limit tilting of the boat by impingement upon the water while said sponson pivots freely to maintain its long dimension parallel to the line of travel of the boat.

18. The combination of claim 17 which includes means for adjusting the length of the depending arm.

19. The combination of claim 1 in which the sail frame includes an inner mounting portion pivoted on the mounting arm, an outer sail stretching portion fixed to the periphery of the sail, and connecting members fixed to the inner portion and to the outer portion of the sail frame.

20. The combination of claim 1 in which the boom is supported for 360° rotation about the pivot axis, and the boom control means is adapted to control the rotational position of the boom throughout the entirety of said 360° rotation.

21. In a sail rig for a wind propelled vehicle that has a deck surface, the improvement comprising, in combination:

a support fixedly mounted on said vehicle that provides a pivot axis generally normal to the deck surface;

a boom that has a proximal end pivoted on said support for rotation about said pivot axis and a distal end with an integral, upwardly extending sail mounting arm;

a lightweight sail frame pivoted on said mounting arm to turn about a rotational axis that is transverse to a plane that contains the pivot axis and the boom, said sail frame having a first nearly upright position and a neutral position substantially parallel to the deck surface;

a sail that has its periphery fixedly secured to the sail frame so that said sail may turn about said rotational axis between said first position and said neutral position;

means constantly biasing said sail frame to said neutral position, whereby said sail frame and sail must be restrained against moving to said neutral position;

a sail control line secured to said sail frame and operable by a person in the vehicle to set the sail frame and sail at any desired angle between said neutral position and said first position, and also to permit the sail frame and sail to be retained at said desired angle;

and boom control means operable by a person in the vehicle to control the rotational position of the boom on the pivot axis.

22. The combination of claim 21 in which said means biasing the sail frame consists of a spring that acts between the mounting arm and the sail frame.

23. In a sail rig for a wind propelled vehicle that has a deck surface, the improvement comprising, in combination:

a support on said vehicle providing a pivot axis generally normal to the deck surface;

a boom comprising a first boom member that has a proximal end pivoted on said support for rotation about said pivot axis, and a second boom member that telescopes relative to the first boom member to adjust the length of the boom between a minimum and a maximum length, said second boom member having a distal end;

an upwardly extending sail mounting arm fixed to said distal end of the boom, said mounting arm having an upper end; a rotational a lightweight sail frame pivoted on axis on said upper end of the mounting arm for movement between a first nearly upright position and a neutral position substantially parallel to the deck surface;

a sail fixedly secured to the sail frame for movement therewith, the location of the sail frame relative to said rotational axis, and the structure and shape of the sail frame and the sail being so coordinated that the sail frame and sail are urged by gravity to said first position and tend to be moved toward said neutral position by wind pressure on the sail;

a manual sail control element secured to said sail frame so a person on the vehicle may set the sail at any desired angle between said first position and said neutral position;

and boom control means operable by a person on the vehicle to control the rotational position of the boom on the pivot axis.

24. The combination of claim 23 in which the boom includes means operable by a person in the vehicle for telescoping the second boom member relative to the first boom member.

25. The combination of claim 24 in which the means operable by a person in the vehicle comprises a screw and nut drive and a hand crank for operating said drive.

26. The combination of claim 23 that includes interengaging latch means on the first and second boom members to limit the maximum length to which the boom may be adjusted.

27. The combination of claim 23 in which the means for moving the sail frame to said neutral position comprises means biasing said sail frame to said neutral position.

28. In a sail rig for a wind propelled vehicle that has a deck surface, the improvement comprising, in combination:

a support on said vehicle providing a pivot axis generally normal to the deck surface;

a pivot on the support that is generally parallel to the deck surface;

a boom that has a proximal end mounted on said pivot or rotation about the pivot and about said pivot axis, and a distal end;

means for rotating the boom about the pivot to various angles relative to the pivot axis;

an upwardly extending sail mounting arm fixed to said distal end of the boom, said mounting arm having an upper end;

a lightweight sail frame pivoted on a rotational axis on said upper end of the mounting arm for movement between a first nearly upright position and a neutral position substantially parallel to the deck surface;

a sail fixedly secured to the sail frame for movement therewith, the location of the sail frame relative to said rotational axis, and the structure and shape of the sail frame and the sail being so coordinated that the said frame and sail are urged by gravity to said first position and tend to be moved toward said neutral position by wind pressure on the sail;

a manual said control element secured to said sail frame so a person on the vehicle may set the sail at any desired angle between said first position and said neutral position;

and boom control means operable by a person on the vehicle to control the rotational position of the boom on the pivot axis.

29. The combination of claim 24 which includes a spring that acts between the mounting arm and the sail frame to bias the sail frame and sail to the neutral position.

* * * * *